US008266813B2

(12) United States Patent
Grunert et al.

(10) Patent No.: US 8,266,813 B2
(45) Date of Patent: Sep. 18, 2012

(54) EXHAUST AIR DRYER WITH HEAT EXCHANGER

(75) Inventors: Klaus Grunert, Berlin (DE); Uwe-Jens Krausch, Brieselang (DE); Günter Steffens, Dallgow-Döberitz (DE); Andreas Stolze, Falkensee (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 470 days.

(21) Appl. No.: 12/503,923

(22) Filed: Jul. 16, 2009

(65) Prior Publication Data

US 2010/0011608 A1 Jan. 21, 2010

(30) Foreign Application Priority Data

Jul. 16, 2008 (DE) ..... 10 2008 033 388

(51) Int. Cl.
*F26B 11/00* (2006.01)

(52) U.S. Cl. ..... 34/85; 34/90; 34/595; 68/5 R; 68/17 R

(58) Field of Classification Search ..... 34/85, 90, 34/595, 601, 606, 610, 242; 68/5 R, 17 R
See application file for complete search history.

(56) References Cited

U.S. PATENT DOCUMENTS

| | | | | |
|---|---|---|---|---|
| 5,852,882 | A * | 12/1998 | Kendall et al. | 34/599 |
| 7,395,612 | B2 * | 7/2008 | Jeong et al. | 34/602 |
| 2004/0123489 | A1 * | 7/2004 | Pancheri et al. | 34/597 |
| 2004/0123490 | A1 * | 7/2004 | Pancheri et al. | 34/597 |
| 2005/0044744 | A1 * | 3/2005 | Tadano et al. | 34/596 |
| 2005/0126034 | A1 * | 6/2005 | Jeong et al. | 34/602 |
| 2010/0011608 | A1 * | 1/2010 | Grunert et al. | 34/85 |

FOREIGN PATENT DOCUMENTS

| | | | |
|---|---|---|---|
| DE | 3000865 | A1 | 7/1981 |
| DE | 10002743 | A1 | 8/2001 |
| DE | 102006018469 | A1 | 10/2007 |
| DE | 102008033388 | A1 * | 1/2010 |

* cited by examiner

*Primary Examiner* — Stephen M. Gravini
(74) *Attorney, Agent, or Firm* — James E. Howard; Andre Pallapies

(57) ABSTRACT

An exhaust air dryer with a drying chamber for items to be dried. The dryer includes a process air fan, a heat exchanger which includes a heat source, a heat sink of a heat pump, and a flushing device for flushing of a first inflow surface of the heat source and a second inflow surface of the heat sink with a liquid which is assigned to the heat source and the heat sink for removing of soil; and air ducts interconnecting the drying chamber, the process air fan, and the heat exchanger for conducting process air.

17 Claims, 7 Drawing Sheets

EXHAUST AIR DRYER WITH HEAT EXCHANGER

BACKGROUND OF THE INVENTION

The invention relates to an exhaust air dryer with a drying chamber for items to be dried, which has a process air fan and at least one heat exchanger, wherein the drying chamber, the process air fan and the heat exchanger are interconnected by means of air ducts for the conveying of process air.

Such an exhaust air dryer follows from DE 30 00 865 A1.

Dryers for items of laundry and items of a similar kind are generally embodied as exhaust air dryers or condensation dryers. In the case of exhaust air dryers a stream of air is sucked in from the environs of the dryer, heated, directed over items to be dried and subsequently expelled from the dryer as "exhaust air". This exhaust air contains all the moisture removed from the items to be dried, and can therefore not simply be released into the building, as this moisture would precipitate out therein; rather, the exhaust air must be directed out of the building by means of a corresponding exhaust air hose. This is a constructive disadvantage of the exhaust air dryer, which is at the same time of great structural simplicity and thus low in cost. A condensation dryer, whose method of functioning relies on the condensation of the moisture evaporated from the items to be dried by means of process air conducted in a closed circuit, requires no hose for expulsion of the moisture-laden process air, as the moisture condensed therein is stored as liquid, and disposed of after completion of the drying, and can thus be used in an internally located utility room or inside laundry room of a larger residential complex. All this applies both to dryers intended specifically for drying laundry and to so-called washer/dryers, that is appliances capable of both washing and drying laundry. Any subsequent reference to a "laundry dryer" or simply "dryer" thus applies both to a device intended for drying and to one designed equally for washing and drying.

Both in a conventional exhaust air dryer and in a conventional condensation dryer, the heat fed to the process air is largely lost. In an exhaust air dryer, the heat is carried away with the process air laden with moisture from the items to be dried, while in a condensation dryer the heat reaches a cooling medium, generally cooling air from the environs of the dryer via a heat exchanger, and is thus equally lost.

In a laundry drying device equipped with a heat pump, the cooling of the warm, moisture-laden process air and the condensing out of the moisture contained essentially take place in a first heat exchanger of the heat pump, which forms a heat sink, as heat is taken into the heat pump via said heat sink. From the heat sink, the heat pump pumps the absorbed heat into a second heat exchanger, a heat source, where the pumped heat, along with additional heat generated during operation of the heat pump, is given off again. The heat sink is in particular an evaporator, where the transferred heat is used to evaporate a coolant circulating in the heat pump. Such coolant, which is evaporated as a result of the heat, is fed, via a compressor, to the heat source, in this case hereinafter referred to as "condenser", where heat is given off through condensation of the gaseous coolant, which is in particular in turn used to heat the process air before it comes into contact with the items to be dried. The liquefied coolant returns to the evaporator through a throttle element, which reduces its pressure, in order there to evaporate subject to the further absorption of heat from the process air. Compressor-combinations, as previously described, are employed as customary heat pumps. As a rule, these operate optimally within a specific temperature range. Other types of heat pumps are conceivable, in particular heat pumps which make use of the Peltier effect, a regenerative gas circuit or a sorption effect.

A combination system for heat recovery in an exhaust air dryer is known from the document DE 30 00 865 A1, which is a simple air-to-air heat exchanger. Here, heat is removed from the exhaust air in the heat exchanger, and fed to the inflowing supply air, which as a rule flows into the heat exchanger surfaces in ambient conditions (e.g. 20° C. and 60% relative air humidity), and is thus pre-heated before reaching a resistance heating unit and the laundry to be dried.

SUMMARY OF THE INVENTION

Heat exchangers, in the case of a heat pump the heat sink, tend, independently of the arrangement on the inflow surfaces, where they are first reached by the flow of process air, to be subject to severe soiling by fluff, which the process air draws out of the laundry to be dried and carries along with it. In the case of a known condensation dryer with a heat pump, its heat sink is connected from the airflow perspective such that by far the majority of the dirt particles (fluff etc.) suspended in the process air is deposited thereupon, which leads to a reduction in the airflow volume and thus to a deterioration in the performance figures and energy consumption. In order to avoid soiling of the heat sink it is known in the first instance that a generally removable and cleanable filter (e.g. fluff filter) is arranged upstream thereof. Flushing devices for cleaning of a heat sink of a condensation dryer with a heat pump are known. In each case, controlled treatment of the fluff is necessary in order to prevent impairment of the efficiency of the dryer by fluff, at least however to limit such impairment.

To date, exhaust air dryers with heat recovery have failed to establish themselves in the marketplace; exhaust air dryers are appreciated primarily as simple, low-cost dryers, which require very little maintenance; in the case of an exhaust air dryer with heat recovery however, both an increased price attributable to the heat exchanger or the heat pump and greater maintenance effort as a result of the need to dispose of the condensate occurring and any possible fluff accumulating can be expected. A further, hitherto little appreciated problem also applies: an exhaust air dryer takes the process air needed for a drying process from its surroundings, and guides it across the items to be dried just once in an open circuit. Dust, fibers and other particles to which the environment is subject can thus reach the items to be dried and there, under certain circumstances, become concentrated.

It is an object of the present invention to specify an exhaust air dryer of the type defined at the outset, in which the possibility is created of restricting or even eliminating a deterioration of efficiency as a result of soiling of the heat exchanger, where both soiling by fluff in the exhaust air dryer and soiling by dust and the like from the environs of the exhaust air dryer are taken into account.

An inventive exhaust air dryer with a drying chamber for items to be dried, which has a process air fan and a heat exchanger, wherein the drying chamber, the process air fan and the heat exchanger are interconnected by means of air ducts for conducting process air. The heat exchanger includes a heat source and a heat sink of a heat pump, wherein a flushing device for flushing of a first inflow surface of the heat source and a second inflow surface of the heat sink with a liquid is assigned to the heat source and the heat sink for the removal of soiling.

By means of the flushing device, the associated inflow surface or inflow surfaces can be cleaned, whereby adhering soiling (fluff, suspended particles etc.) is removed. A deterioration in efficiency as a result of any soiling by fluff, dust or the like is thereby sharply reduced or even eliminated. Given the presence of a flushing device, a filter and its regular maintenance can if appropriate be dispensed with, which enhances the user-friendliness of the exhaust air dryer.

The flushing device can be used as an alternative to or in addition to a filter (e.g. fluff filter) for an inflow surface or inflow surfaces. A flushing device typically has at least one feed line for flushing liquid, e.g. water, which ends in an outlet aperture for the flushing liquid. Flushing liquid dispensed through the outlet aperture soaks the inflow surface(s) and flushes away any adhering soiling. A flushing device can have a multiplicity of feed lines, as well as a multiplicity of outlet apertures per feed line. An outlet aperture can have a distributor head for directing the emerging flushing liquid, e.g. a spray head. The feed line can in particular be a pressure line, through which pressurized flushing liquid is conveyed to the outlet aperture. The flushing device can further have one or more stop valves, as well as one or more pumps. An inflow surface can have one uniform surface or a number of subsidiary surfaces.

For selective cleaning, a flushing device can be present in each case for flushing of the first inflow surface and the second inflow surface, which are preferably separately controllable for each of the inflow surfaces. Such a solution is, however, comparatively costly.

For the purposes of simple structural embodiment it is preferable, if a shared flushing device is present for flushing of the first inflow surface and of the second inflow surface. If appropriate, a separate line branch can be present for each of the inflow surfaces, which can be optionally opened and closed on an individual basis.

In one embodiment of the inventive exhaust air dryer, the air ducts comprise a supply air duct to feed process air to the first inflow surface and a heat sink inlet channel to feed process air to the second inflow surface, between which is arranged a through-opening which can be sealed by means of a flap, where the shared flushing device is arranged on one side of the through-opening and is set up, when the through-opening is open, to flush both inflow surfaces. The activated flushing device thus also flushes the inflow surface located on the other side of the through-opening through the open through-opening. In the case of a non-activated flushing device, the flap and thus the through-opening are closed, in order to prevent an exchange of air between the air ducts during drying operation, and thus a reduction of the efficiency of the heat pump.

In an alternative embodiment of the inventive exhaust air dryer, the inflow surfaces are arranged one above the other with reference to a vertical (which specifies the direction of the gravitational force at the location of the exhaust air dryer), and the air ducts comprise a supply air duct to feed process air to the first inflow surface and a heat sink inlet channel to feed process air to the second inflow surface, between which is arranged a through-opening which can be sealed by means of a flap, wherein the at least one flushing device is arranged above the through-opening for flushing essentially of only the upper inflow surface, and the through-opening is set up for runoff of flushing liquid from the upper inflow surface, the flushing liquid running downward over the lower inflow surface. In other words in this embodiment only the upper inflow surface is actively flushed. The through-opening is set up and arranged for the runoff of flushing liquid from the upper inflow surface to the lower inflow surface. The lower inflow surface is thus washed over by flushing liquid flowing down from the upper inflow surface and thereby cleaned.

It is here in particular preferable that the upper inflow surface is the inflow surface of the heat source. This is mostly arranged on the inlet side of the process air fan, while the heat sink is generally arranged on the discharge side.

To prevent residual flushing liquid collecting, an edge of the through-opening preferably directly abuts or extends almost to the inflow surfaces. For thorough cleaning, the width of the through-opening preferably extends generally at least across the width of the inflow surfaces.

For coordinated movement of the flap it may be preferable if a control element is connected to the flap in order to control it. The movement can take the form of complete opening and closing, as well as optional intermediate positions. The control element can be a passive control element, which thus cannot be selectively actuated externally, e.g. a spring element, or can be an active control element, e.g. an electric motor or another actuator, if appropriate with corresponding force transmission elements such as levers etc.

The inflow surfaces are preferably arranged in a coplanar manner, so that they lie in a common plane. With regard to the verticals they can be arranged next to each other or one above the other.

An arrangement of the named components embodied in adjacent form is in particular taken to mean a positioning in which these components are arranged next to each other with essentially similarly oriented longitudinal axes when viewed in a direction in space on the home appliance and without overlapping in a direction in space vertically relative to the viewing direction.

In particular in the case of the use of inflow surfaces arranged one of top of the other, of which only the upper one is actively flushed, it is preferable that the control element has a spring element to press the flap down onto the through-opening. The spring element can press the flap onto the through-opening from below (compression spring) or pull it (tension spring). The spring element is preferably embodied such that the closing force prevents the flap opening during regular drying operation.

If the upper inflow surface is the inflow surface of the heat source and the lower inflow surface is the inflow surface of the heat sink, as the heat source is generally arranged on the inlet side and the heat sink generally on the pressure side of the process air fan, a pressure drop applies at the flap, which presses this upwards. Where the flap is pressed from below onto the flushing liquid through-opening, the spring dimension then only needs to be sufficiently large that the flap with the pressure drop presses on the through-opening. In an extreme case, the flap is held against the opening solely by the pressure drop in opening mode operation; the flap then serves only to ensure the closure at the beginning of the drying process. In the case of non-activated drying, the flap is able to hang down; this improves flushing liquid throughput, but may possibly not guarantee closure of the flap in drying mode operation. The spring element can further be embodied such that the flap opens during a flushing process under the weight of the flushing liquid against the force exerted by the spring element, so that water can flow downwards. To this end the spring is designed to be sufficiently weak to avoid the accumulation of flushing liquid on the flap during the flushing process and flushing liquid residues after the flushing process.

In order not to disrupt the flushing process when the flap is open, it is preferable if during a flushing process the process air fan is switched off.

The heat source and the heat sink are preferably arranged relative to each other in such a way that direction of flow of the process air through the heat source is parallel to, in particular parallel and opposite to the direction of flow of the process air through the heat sink. The longitudinal axes of both components thus preferably extend parallel to each other.

A housing flap is preferably arranged on one wall of the home appliance, via which the heat source or the heat sink is accessible, and further preferably both are accessible. As well as the envisaged specific positioning of both components adjacent to each other, this arrangement in close proximity to the wall can also guarantee simple accessibility via the housing flap. By providing just a single housing flap, through the opening of which both components are accessible at the same time for cleaning or maintenance purposes, a particularly advantageous embodiment can be created. In particular, at least one housing flap, in particular the only housing flap, is embodied on a front wall of the home appliance.

If appropriate, a filter may be arranged before the heat source in the direction of flow of the process air. In particular this filter is then arranged so as to be non-destructively releasable, so that it can be reversibly removed and re-installed or replaced with another filter.

A particularly preferable embodiment of the inventive exhaust air dryer envisages that in the heat pump the heat source is a condenser for a vaporously fed coolant and the heat sink is an evaporator for the vaporously fed coolant, and that the heat pump has a compressor and a throttle element, which are connected with the condenser and the evaporator to form a closed circuit for the coolant. In this embodiment the heat pump is thus a compressor-heat pump. The coolant is in particular selected from the well-known fluorated hydrocarbon compounds R134a and R152a, the mixtures of such compounds R 407C and R410A, and propane (R290) and carbon dioxide (R744).

To reduce pressure losses in particular at the heat source, the process air fan can preferably be arranged before the drying chamber in the direction of flow ("pressure-exerting system").

However, for compelling structural reasons for example, it may also be preferable if the process air fan is arranged behind the drying chamber in the direction of flow ("suction-exerting system").

BRIEF DESCRIPTION OF THE DRAWINGS

Exemplary embodiments of the invention are explained in greater detail on the basis of the schematic diagram. Identical or identically functioning components can be provided with the same reference numbers, wherein.

In the Figures identical or functionally identical elements are provided with the same reference numbers.

DETAILED DESCRIPTION OF THE PRESENT INVENTION

Figure 1:
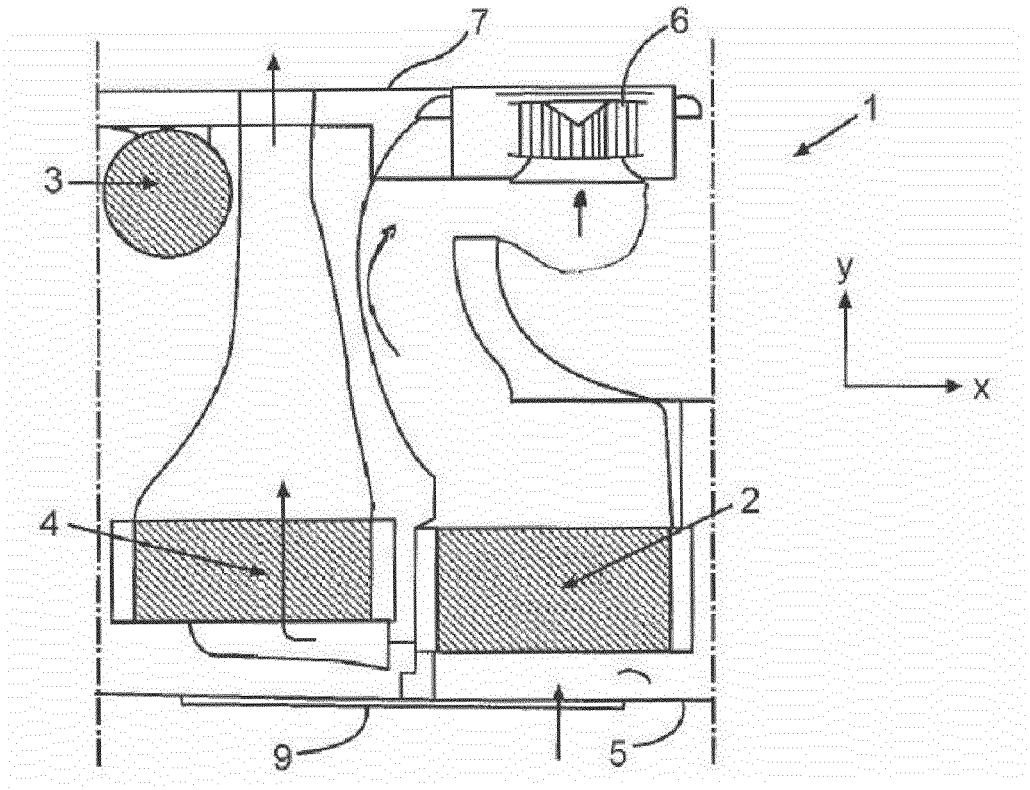
FIG. 1 shows a schematic top view of an exemplary embodiment of an exhaust air dryer.

FIG. 1 shows a schematic top view of the exhaust air dryer 1, where only components essential for explanation of the invention are represented. The exhaust air dryer 1 comprises a heat pump 2, 3, 4, 10 with a condenser 2, which represents the heat source 2, a compressor 3, an evaporator 4, which represents the heat sink 4, and a throttle element 10. In this exemplary embodiment a compressor heat pump 2, 3, 4, 10 is accordingly provided. It is described in detail above, to which reference is made here. A process air fan 6 sucks the ambient air, which, insofar as it is employed in the exhaust air dryer 1 is also generally designated "process air", as supply air through a frontal housing wall 5 via the condenser 2 and corresponding air ducts according to the arrow representation into the drum 8 functioning as the drying chamber 8 (see FIG. 2). After emerging from the drum 8, the moisture-laden process air is directed according to the arrow representation through the evaporator 4, and after emerging from the evaporator 4 via the rear wall 7 out of the exhaust air dryer 1 into the environment.

In light of the conveying of process air in an open circuit, the exhaust air dryer 1 is rightly designated as such; it should however be noted that the condensing of moisture can occur in this exhaust air dryer 1: At the evaporator 4, the process air flowing from the items to be dried and laden with moisture in the form of steam is cooled, and the condensing-out of moisture must accordingly be reckoned with. Care must therefore be taken that condensate accumulating is captured. If not otherwise provided for, such condensate can be collected in a conventional manner in a collector receptacle for subsequent disposal. Appropriate means are generally known; for clarity of overview they are, however not shown as being present.

In the embodiment shown, the condenser 2 and the evaporator 4 are arranged adjacent to each other when looking at the front wall 5 and thus when viewed in the in y-direction. In addition, the condenser 2 and the evaporator 4 are arranged at a distance from each other in the x-direction, wherein it is in particular also envisaged that the positioning of the condenser 2 and of the evaporator 4 is embodied such that their longitudinal axes, which extend in the y-direction, are arranged parallel to each other. In the embodiment shown, the process air guide is embodied such that the direction of flow of the process air through the evaporator 4 or the condenser 2 are oriented parallel to each other and in the same direction. Alternatively it can also be provided for this direction of flow to run through the evaporator 4 and the condenser 2 parallel to each other, but in opposite directions.

In addition, the condenser 2 and the evaporator 4 are arranged adjacent to each other in the exhaust air dryer 1, and in close proximity to the front wall 5 in the interior. In the exemplary embodiment a housing flap 9 is arranged on the front wall 5, so that by opening this housing flap 9, both components, namely the condenser 2 and the evaporator 4, are accessible via the front face of the exhaust air dryer 1. The housing flap 9 is shown symbolically only in FIG. 1.

In addition, a filter 11 (not shown in FIG. 1, but see FIG. 2) which is reversibly and non-destructively installable and removable, is arranged before the condenser 2 in the direction of flow of the process air.

There are in addition different embodiments for guidance of the process air, depending upon whether the system is a "pressure-exerting system", that is a process air fan 6 is located before the drum 8 in the direction of flow, or the greatest pressure losses occur behind the process air fan 6 in the direction of flow, or a "suction-exerting system", in which the relationships are correspondingly reversed. In this connection, FIG. 1 shows a pressure-exerting system.

Figure 2:
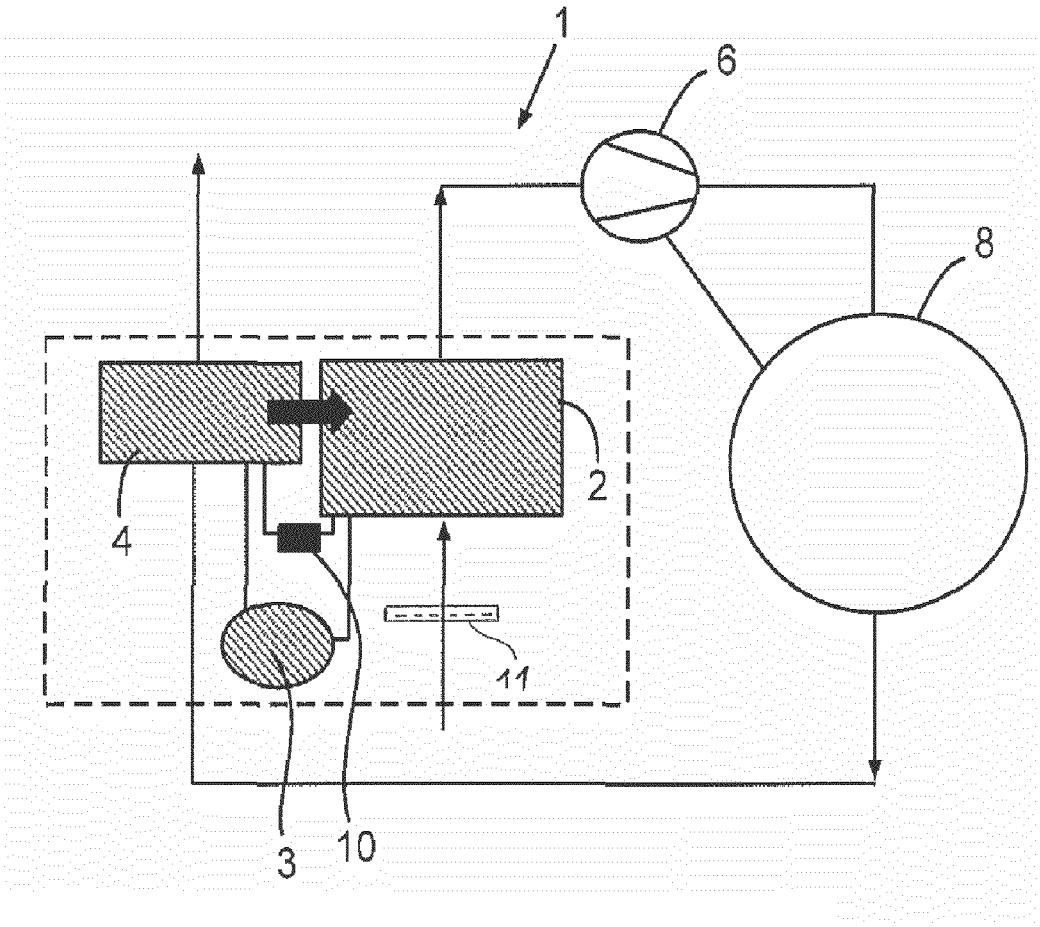
FIG. 2 shows a schematic block diagram of the exhaust air dryer according to FIG. 2.

FIG. 2 shows a schematic block diagram of the exhaust air dryer 1 according to FIG. 1. The exhaust air dryer 1 has a drum 8 rotatable about a horizontal axis, which is embodied as a drying chamber 8. The supply air sucked in from the environs of the exhaust air dryer 1 by the fan 6 is initially directed through the filter 11 and then through the condenser 2. In the condenser 2, the coolant flowing through the coolant circuit liquefies, giving off heat to the process air. The coolant, which is now in liquid form, is subsequently conveyed to a throttle element valve 10 and via this once again to the evaporator 4. The coolant circuit is thereby closed. The further course of flow of the process air after exit from the condenser 2 has already been explained with reference to FIG. 1. After emerging from the drum 8, the moist process air passes through the evaporator 4, where it is cooled. After leaving the evaporator 4, the process air is given off into the environment.

Drive power for the drum 8 and the fan 6 is provided via a shared motor.

Figure 3:
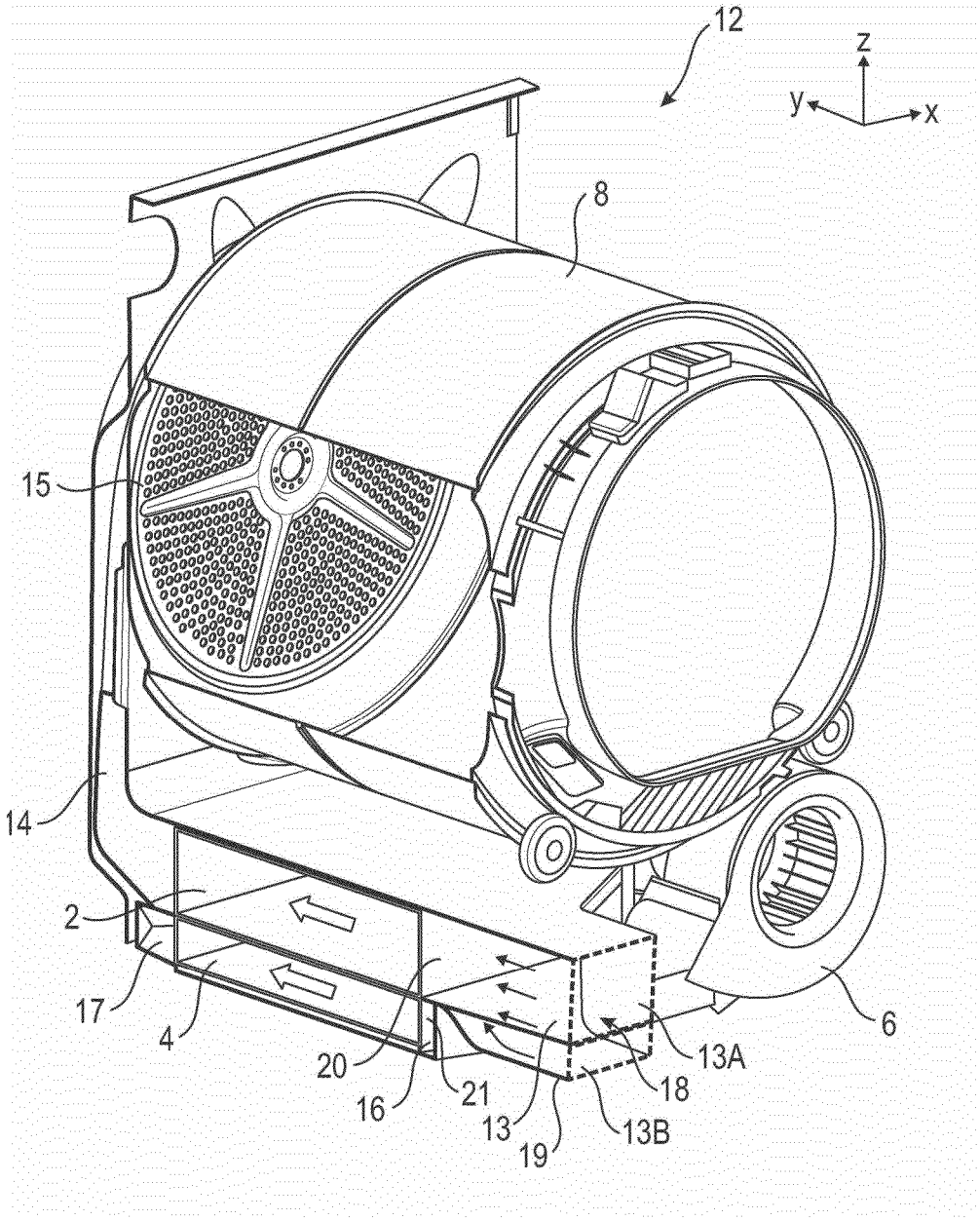
FIG. 3 shows an oblique sectional view of components of an exhaust air dryer in their physical embodiment.
Figure 4:
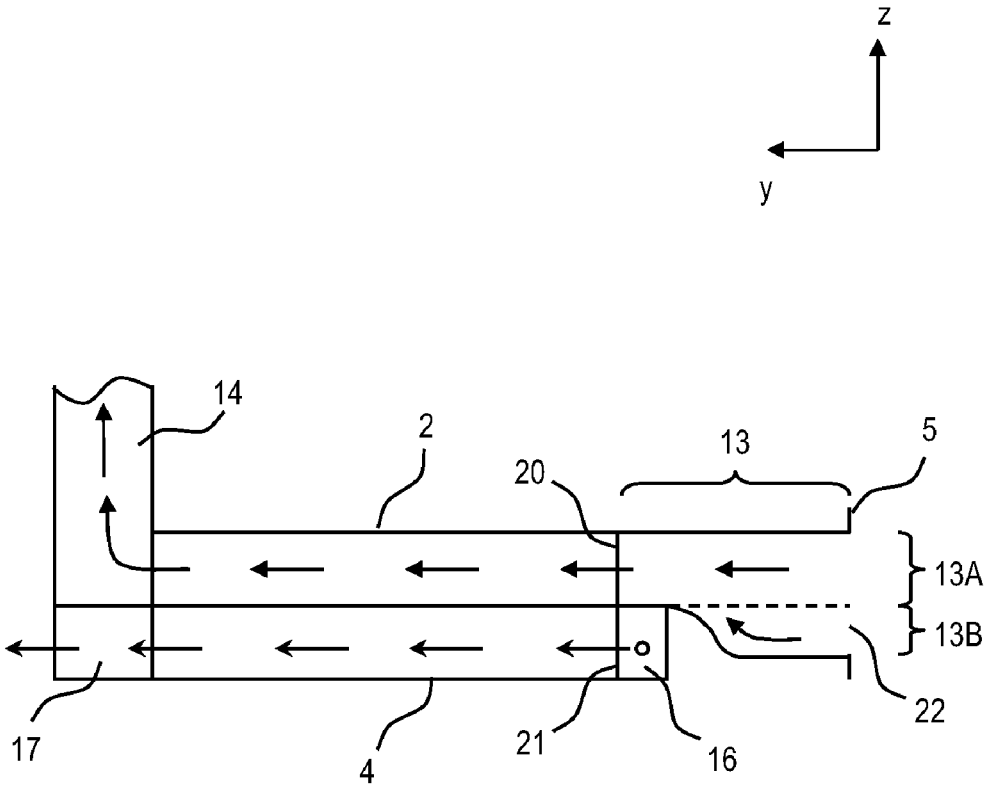
FIG. 4 shows a side-view sectional sketch of a section of the exhaust air dryer 12 from FIG. 3 in the area of the heat exchanger.

FIG. 3 shows components of a heat pump exhaust air dryer 12 according to a further embodiment which is now described together with FIG. 4. To this end, FIG. 4 shows a section of the exhaust air dryer 12 from FIG. 3 in the area of condenser 2 and evaporator 4.

In drying operation, supply air (ambient air) is sucked in from outside via a supply air duct 13. The supply air duct 13 leads from the front 5 of the exhaust air dryer 12 to a condenser 2, through which the supplied air flows, as indicated by the associated arrow/arrows. Behind the condenser 2, the air is directed via a drum inlet channel 14 through a perforated rear wall 15 into a drum 8, and sucked out again by means of a fan 6. The configuration shown here thus involves a suction-exerting system. From the pressure side of the fan 6, the then moist air is conveyed through an evaporator inlet channel 16 extending in the x-direction to an evaporator 4, through which the moist air flows, as indicated by the associated arrow/arrows pointing in the y-direction. Behind the evaporator 4 is arranged an exhaust air duct 17, through which the air blown through the evaporator 4 is conducted outside. The various ducts 13,14,16,17 can also be described as individual sections of one process air duct.

The supply air duct 13 is embodied such that it is straight over its entire length in a partial cross-section 13A, which leads from an upper, part-surface (indicated by a dotted line) of an intake 18 in a straight line in the direction of flow (indicated by the associated group of arrows pointing in the y-direction) to the condenser 2. An essentially straight-line flow (without deflection) of the suction air from the intake 18 to the condenser 2 is thereby achieved, whereby flow losses can be prevented. In other words the exhaust air dryer 12 is embodied so as to enable an essentially straight-line flow of supply air from an intake 18 to the condenser 2, at least in partial cross-section.

The partial cross-section 13B of the intake 18 belonging to the lower part-surface (indicated by the dotted line) has a flow cross-section which does not lead in a straight line over its entire length in the direction of flow from the intake 18 to the condenser 2, but is deflected by means of an air baffle 19 to the condenser 2, as indicated by the curved arrow. A certain flow loss is thereby caused, which, however, is less than applies to a sharply or multiply curved air guide. By means of the air baffle 19, the flow-cross-section of the supply air duct 13 as a whole is reduced in the direction of flow to an inflow surface 20 of the condenser 2, which corresponds to a side wall of the condenser 2.

The intake 18 preferably leads to a frontal housing wall, and there abuts a corresponding housing aperture 22. This housing aperture can be regarded as a part of the intake. In other words, the exhaust air dryer 12 is then embodied such that it enables a straight-line flow of ambient air from outside, in particular from a front face, to the condenser 2 at least in partial cross-section of the supply air flow.

In order to achieve a straight-line, laminar airflow, the longest possible supply air duct 13 is desirable. It is thus preferable to truncate the condenser 2 in the direction of flow (y-direction) and locate it as far as possible from the intake 18, here in a rear part of the exhaust air dryer 12. It is preferable if the heat exchange surface of the condenser 2 is smaller than 5 $m^2$, and preferably smaller than 2 $m^2$.

As a result of the evaporator inlet channel 16 being narrow due to construction space constraints, the moist air conveyed thereby in the (−x)-direction from the drum is deflected sharply (at most at right angles) in the y-direction onto the associated inflow surface 21 of the evaporator 4, whereby a flow loss occurs. It is desirable, in order to reduce flow losses, to achieve the longest possible stretch (in the y-direction) after a final flow deflection before the evaporator 4. Accordingly it is preferable to truncate the evaporator 4 in the direction of flow (y-direction), and locate it in a rear part of the exhaust air dryer 12. It is preferable if the heat exchange surface of the evaporator 4 is also smaller than 5 $m^2$, preferably smaller than 2 $m^2$.

In the embodiment shown here, the condenser 2 and the evaporator 4 are arranged directly one above the other, whereby particularly compact structural dimensions can be achieved. The air streams through the condenser 2 and the evaporator 4 are parallel and in the same direction.

The exhaust air dryer 12 further has a flushing system for cleaning the inflow surfaces 20, 21, as explained in greater detail with reference to FIG. 6.

Figure 5:
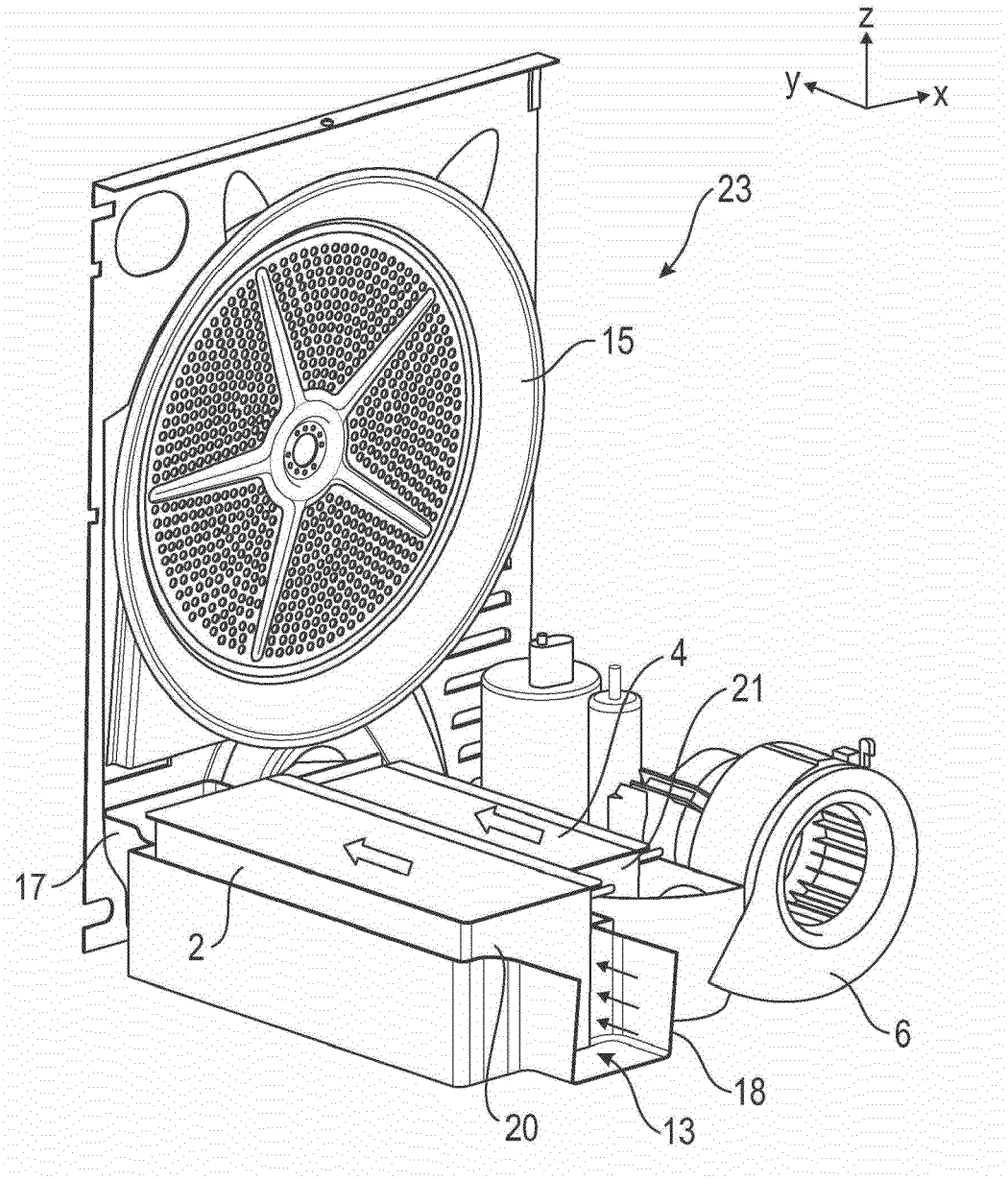
FIG. 5 shows an oblique sectional view of components of an exhaust air dryer in their physical embodiment according to a further embodiment.

FIG. 5 shows a further exemplary embodiment of an exhaust air dryer 23 in a view similar to that of FIG. 3, where, for the purposes of greater clarity, the drum 8 is not represented. In this exemplary embodiment the condenser 2 and the evaporator 4 are now arranged in a laterally directly adjacent manner. The supply air duct 13 conducts supply air over its length essentially through its entire flow cross-section straight to the condenser 2, thus having no air baffle for deflection to the condenser 2. The evaporator 4 is arranged in closer proximity to the fan 6 than the condenser 2, and also embodied to be shorter (in the y-direction).

Figure 6:
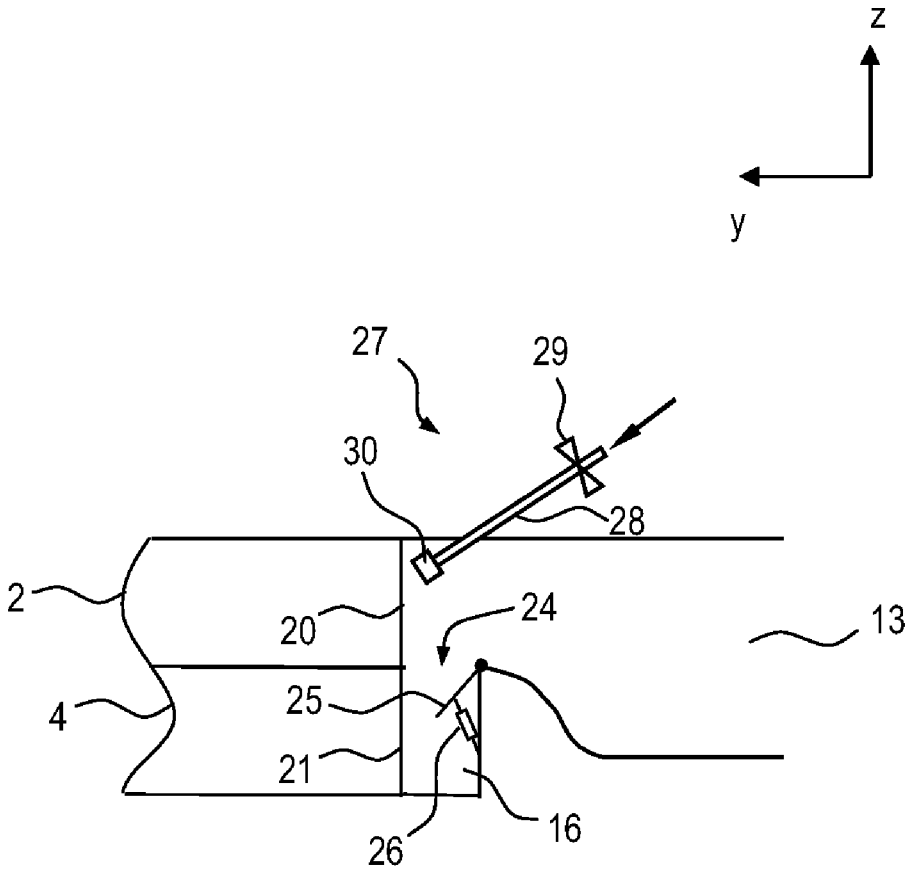
FIG. 6 shows a side-view sectional sketch of a section of the exhaust air dryer 12 from FIG. 3 and FIG. 4 in the area of the inflow surfaces of the heat exchanger.

FIG. 6 shows a section of the exhaust air dryer 12 from FIG. 3 and FIG. 4 in the area of the inflow surfaces 20, 21 of the heat exchanger 2 or 4. The supply air duct 13, which leads to the first inflow surface 20 of the condenser 2, and the evaporator inlet channel 16, which leads to the evaporator 16, are not as previously permanently separated from each other from the flow-related perspective, but are initially connected via a through-opening 24 for flushing liquid over the width of the inflow surfaces 20, 21 (along the x-direction). In order to avoid efficiency being based on an internal heat circuit, the flushing liquid through-opening 24 can be closed from below by means of a flap 25. For improved representation the flap 25 is here shown in an open position. To set a movement characteristic of the flap 25, a control element 26 in the form of a compression spring is provided, which presses the flap 25 onto the flushing liquid through-opening 24 to seal it. By means of this arrangement, the flap 25 can open or close the flushing liquid through-opening 24 as desired. As well as a passive control element 26, an active control element such as an electric motor can also be used, by means of which the movement of the flap 25 is externally controllable, for example via a signal line.

A flushing device 27, which has a feed line 28 for flushing liquid in the form of a water pipe, leads into the supply air duct 13. The liquid feed through the pipe 28 can be controlled by means of a stop valve 29. A distributor head 30 is arranged on the outlet aperture which leads to the supply air duct 13, which deflects the emerging flushing liquid in such a way that the first inflow surface 20 is directly flushed. The flushing liquid flowing down the first inflow surface 20 carries soiling with it, thus cleaning the first inflow surface 20. At the start of the flushing process, the flap 25 is closed as a result of the spring force acting on it. However flushing liquid running downwards collects on the flap 25, if applicable in a collector channel, and pushes the flap 25 downwards with its weight. The flap 25 thereby opens, and the flushing liquid runs down the second inflow surface 21 of the evaporator 4. The second inflow surface 21 is thereby also cleaned without direct flushing. For ease of flow to the second inflow surface 21, the flushing liquid through-opening 24 leads as far as the inflow surfaces 20, 21.

Flushing liquid running down the second inflow surface 21 can, for example, be drained away by means of the outflow device provided for condensate from the drying process, for example into a collector receptacle for later disposal or to a drain pump. Appropriate means are generally known; for greater clarity, they are not represented as being provided. During a flushing process, the process air fan 6 is switched off.

In the case of an active control element, the flap 25 is opened for flushing by actuation of the control element and closed again upon termination of the flushing process. Flushing liquid residues on the flap 25 can thereby be prevented, and a firmer seating can be guaranteed; this solution is, however, more costly.

In an alternative embodiment, which can also be represented by FIG. 6, the spray head 30 is embodied in such a way that with an open through-opening 24 or flap 25, the second, lower inflow surface 21 too is directly flushed. Flushing liquid is thus directed by the flushing device 27 partly onto the first, upper inflow surface 20, and partly through the through-opening 24 directly onto the second, lower inflow surface 21. In a similar manner, both inflow surfaces 20, 21 can also be flushed in the case of inflow surfaces 20, 21 lying laterally adjacent to each other (see an example of this in FIG. 5).

Figure 7:
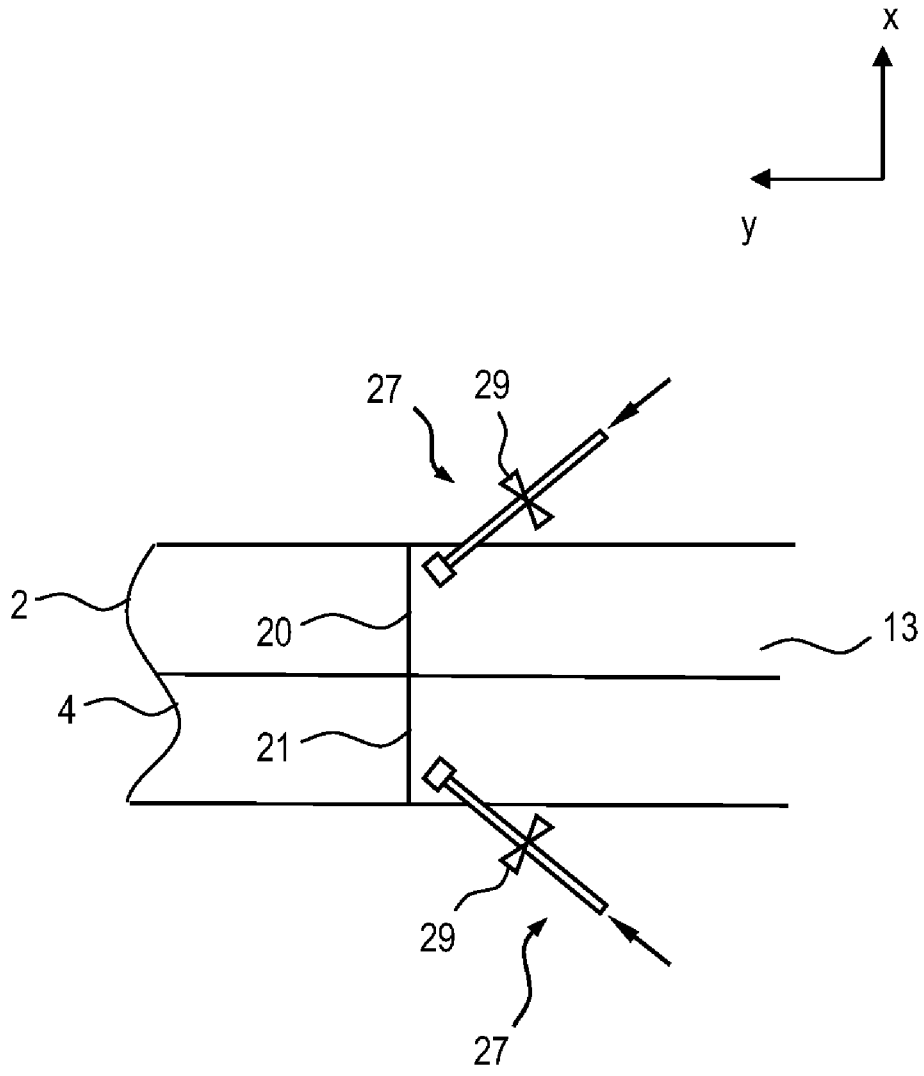
FIG. 7 shows a top-view sectional sketch of a section of the exhaust air dryer 23 from FIG. 5 in the area of the inflow surfaces of the heat exchanger.

FIG. 7 shows a section of the exhaust air dryer 23 in FIG. 5 in the area of the inflow surfaces 20, 21 of the heat exchanger 2 or, as the case may be, 4, where now by contrast to the embodiment in FIG. 6, the supply air duct 13 and the evaporator inlet channel 16 are permanently separated, that is no through-opening is present. Each of the inflow surfaces 20, 21 is flushed by a separate flushing device 27, where outflow devices are provided for draining the flushing liquid, but are not shown. In other words at least one flushing device 27 is present in each case for flushing of the first inflow surface 20 and the second inflow surface 21. These can, for example, separately tap into a cold water line, and can be separately activated. In an alternative embodiment, both flushing devices 27 are different branches of a single flushing device, which can be actuated separately (for example by separate actuation of the stop valves 29). In another further possible embodiment, both flushing devices 27 are different branches of a single flushing device, which can only be actuated jointly. The arrangement shown can be used for inflow surfaces 20, 21 arranged one above the other, laterally adjacent inflow surfaces and distanced inflow surfaces 20, 21; in other words the advantage of such an arrangement is the substantial independence from their positioning within the exhaust air dryer.

The invention is, of course, not restricted to the embodiment shown.

The invention claimed is:

1. An exhaust air dryer with a drying chamber for laundry items to be dried, the dryer comprising:

a process air fan;

a heat exchanger which includes:

a heat source to generate heat to dry the laundry items;

a heat sink of a heat pump; and a flushing device for flushing of a first inflow surface of the heat source and a second inflow surface of the heat sink with a liquid which is assigned to the heat source and the heat sink for removing of soil, said flushing device being adapted and positioned to direct said liquid to flow down and therefore clean the first and second inflow surfaces; and air ducts interconnecting the drying chamber, the process air fan, and the heat exchanger for conducting process air.

2. The exhaust air dryer of claim 1, wherein the flushing device flushes the first inflow surface and the second inflow surface.

3. The exhaust air dryer of claim 1, further comprising a shared flushing device for flushing of the first inflow surface and of the second inflow surface.

4. The exhaust air dryer of claim 3, wherein the air ducts comprise: a supply air duct to feed process air to the first inflow surface; and a heat sink inlet channel to feed process air to the second inflow surface, between which is arranged a through-opening which can be sealed by means of a flap, wherein the shared flushing device is on one side of the through-opening and flushes both inflow surfaces in the case of an open through-opening.

5. The exhaust air dryer of claim 3, wherein the inflow surfaces are arranged one above the other with reference to a vertical, that the air ducts comprise include a supply air duct to feed process air to the first inflow surface and a heat sink inlet channel to feed process air to the second inflow surface, between which is arranged a through-opening which can be sealed by means of a flap, and that the flushing device is arranged above the through-opening essentially to flush only the upper inflow surface, and that the through-opening is set up for outflow of the flushing liquid from the upper inflow surface, wherein an outflowing flushing liquid flows over the lower inflow surface.

6. The exhaust air dryer of claim 4, further comprising a control element connected with the flap for controlling the movement of the flap.

7. The exhaust air dryer of claim 6, wherein the control element has a spring element to press the flap onto the through-opening.

8. The exhaust air dryer of claim 1, wherein the inflow surfaces are arranged in coplanar form relative to each other.

9. The exhaust air dryer of claim 1, wherein a process air fan is switched off during a flushing process.

10. The exhaust air dryer of claim 1, wherein the heat source is a condenser for a vaporously fed coolant and the heat sink is an evaporator for the vaporously fed coolant, and that the heat pump has a compressor and a throttle element, which are connected with the condenser and the evaporator to form a closed circuit for the coolant.

11. The exhaust air dryer of claim 1, wherein the process air fan is arranged before the drying chamber in a direction of flow.

12. The exhaust air dryer of claim 1, wherein the process air fan is behind the drying chamber in a direction of flow.

13. The exhaust air dryer of claim 1, wherein the flushing device comprises a distributor head to direct emerging flushing liquid directly on the first and/or second inflow surfaces.

14. An exhaust air dryer with a drying chamber for laundry items to be dried, the dryer comprising:

a process air fan;

a heat exchanger which includes:

a heat source to generate heat to dry the laundry items, said heat source having a heat source inflow surface;

a heat sink of a heat pump, said heat sink having a heat sink inflow surface; and a flushing device for flushing said heat source inflow surface and said heat sink inflow surface with a liquid for removing soil from said inflow surfaces; and air ducts for conducting process air, said air ducts interconnecting said process air fan and said heat exchanger to the drying chamber.

15. The exhaust air dryer of claim 14, wherein said flushing device includes a liquid supply line.

16. The exhaust air dryer of claim 15, wherein said flushing device includes a stop valve disposed in said liquid supply line.

17. The exhaust air dryer of claim 14, wherein the flushing device comprises a distributor head to direct emerging flushing liquid directly on the first and/or second inflow surfaces.

* * * * *